US007150216B2

(12) United States Patent
Lavoie

(10) Patent No.: US 7,150,216 B2
(45) Date of Patent: Dec. 19, 2006

(54) SAWDUST-FREE WOOD CUTTING METHOD AND APPARATUS

(75) Inventor: Jérôme Lavoie, Saint-Ambroise (CA)

(73) Assignee: Les Consultants Carpe Diem Jerome Inc., Saint Ambroise (CA)

( * ) Notice: Subject to any disclaimer, the term of this patent is extended or adjusted under 35 U.S.C. 154(b) by 0 days.

(21) Appl. No.: 10/998,677

(22) Filed: Nov. 30, 2004

(65) Prior Publication Data

US 2005/0072282 A1 Apr. 7, 2005

Related U.S. Application Data

(63) Continuation of application No. 10/634,873, filed on Aug. 6, 2003, now abandoned, which is a continuation of application No. PCT/CA03/00222, filed on Feb. 14, 2003.

(30) Foreign Application Priority Data

Mar. 1, 2001 (CA) ..... 2374201

(51) Int. Cl.
*B31B 1/25* (2006.01)
*B26D 7/06* (2006.01)

(52) U.S. Cl. ..... 83/873; 83/51; 83/446; 83/447; 83/885

(58) Field of Classification Search ..... 83/51, 83/446, 447, 873, 885
See application file for complete search history.

(56) References Cited

U.S. PATENT DOCUMENTS

| | | | | |
|---|---|---|---|---|
| 2,717,012 A | | 9/1955 | Schneider | |
| 2,722,247 A | * | 11/1955 | Schroeder et al. | 83/446 |
| 4,009,741 A | | 3/1977 | Zimmerman | |
| 4,144,782 A | * | 3/1979 | Lindstrom | 83/446 |
| 4,614,138 A | | 9/1986 | Altman | |
| 4,776,376 A | | 10/1988 | Jaeger | |
| 4,938,111 A | * | 7/1990 | Masse | 83/446 |
| 6,148,706 A | * | 11/2000 | Witjes | 83/51 |

FOREIGN PATENT DOCUMENTS

FR 1277394 10/1960

* cited by examiner

*Primary Examiner*—Timothy V. Eley
*Assistant Examiner*—Jason Prone
(74) *Attorney, Agent, or Firm*—Ogilvy Renault LLP

(57) ABSTRACT

A sawdust-free wood cutting apparatus (10) comprises a guide (62, 72) for guiding a piece of wood (W) along a feed path having a cutting zone. At least one circular blade (18*b*) is mounted in the cutting zone and driven in rotation about an axis transversal to the feed path. The circular blade (18*b*) has a toothless circumferential cutting edge. A feeder (14, 16) advances the piece of wood (W) to be cut through the cutting zone at a linear speed substantially equal to a tangential speed at the toothless circumferential cutting edge of the circular blade (18*b*).

12 Claims, 7 Drawing Sheets

SAWDUST-FREE WOOD CUTTING METHOD AND APPARATUS

RELATED APPLICATION

This application is a continuation of U.S. patent application Ser. No. 10/634,873 filed on Aug. 6, 2003, now abandoned which is a continuation of a PCT/CA03/00222 filed on Feb. 14, 2003 and claiming priority on Canadian Patent Application No. 2,374,201 filed on Mar. 1, 2002.

BACKGROUND OF THE INVENTION

1. Field of the Invention

The present invention relates generally to wood industries and, more particularly, to a sawdust-free cutting method and apparatus.

2. Description of the Prior Art

In conventional sawmill installations, wood pieces are typically sawn by bringing the wood pieces in contact with a rotating circular saw having a toothed outer circumference. There is normally an important speed differential between the advancing speed of the wood pieces and the tangential speed at the periphery of the rotating circular saw. This results in the generation of sawdust, which constitutes an important source of waste.

U.S. Pat. No. 4,009,741 issued on Mar. 1, 1997 to Zimmerman discloses a woodworking machine comprising a number of power driven feed rollers for feeding wood products into and through a cutting zone. The cutting zone includes a pair of coplanar toothed saw blades. An overhead dust collector is provided above the cutting zone to carry away virtually all sawdust generated while the machine is being operated.

U.S. Pat. No. 4,614,138 issued on Sep. 30, 1986 to Altman discloses a cutter apparatus for sheet materials, such as plaster board, wherein a pair of axially spaced, coplanar blades are driven in opposite directions and in a way such as to create a speed differential between respective cutting edges of the blades. During cutting, the sheet material is self-propelled by the action of the blades.

Although the cutting apparatuses described in the above patents are effective for cutting wood products and sheet materials, it has been found that there is a need for a new cutting method and apparatus for cutting a variety of wood products without virtually producing any sawdust.

SUMMARY OF THE INVENTION

It is therefore an aim of the present invention to provide a sawdust-free wood cutting apparatus adapted to reduce wood waste resulting from the generation of sawdust.

It is also an aim of the present invention to provide a new wood cutting method adapted to minimize waste while cutting a piece of wood.

Therefore, in accordance with the present invention, there is provided a sawdust-free wood cutting apparatus comprising:

a frame, a guide mounted to said frame for guiding a piece of wood along a feed path having a cutting zone, at least one circular blade mounted in said cutting zone and driven in rotation about an axis transversal to said feed path, said circular blade having a toothless circumferential cutting edge, a source of power driving said circular blade about said axis, and a feeder advancing the piece of wood to be cut through said cutting zone at a linear speed substantially equal to a tangential speed at said toothless circumferential cutting edge of said circular blade.

In accordance with a further general aspect of the present invention, there is provided a method of cutting a piece of wood, comprising the steps of: driving in rotation a blade having a smooth outer cutting circumference, bringing a piece of wood in contact with said blade at a speed substantially equal to a tangential speed at said smooth outer cutting circumference.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
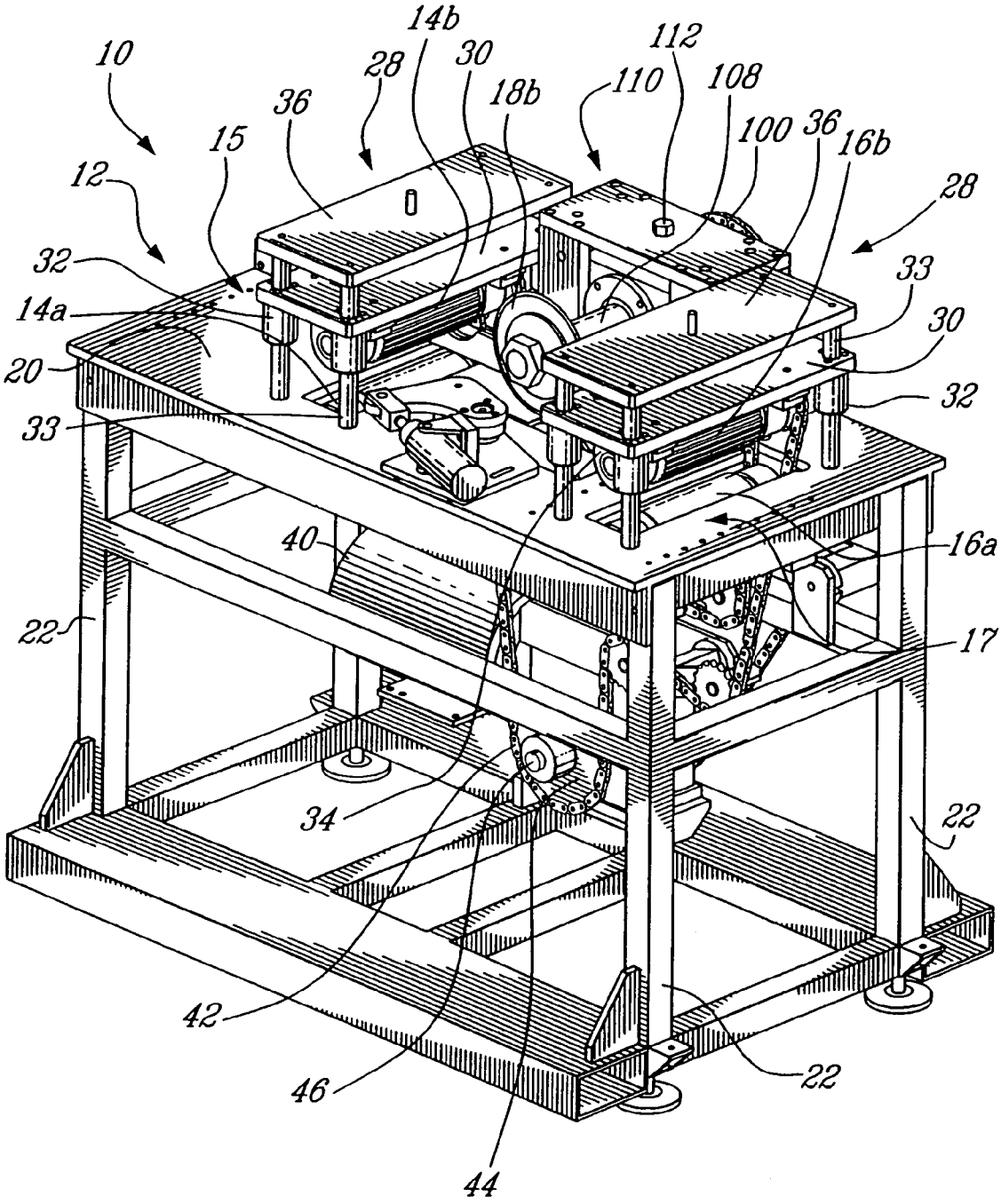
FIG. 1 is a front right perspective view of a sawdust-free wood cutting apparatus in accordance with a first embodiment of the present invention.
Figure 2:
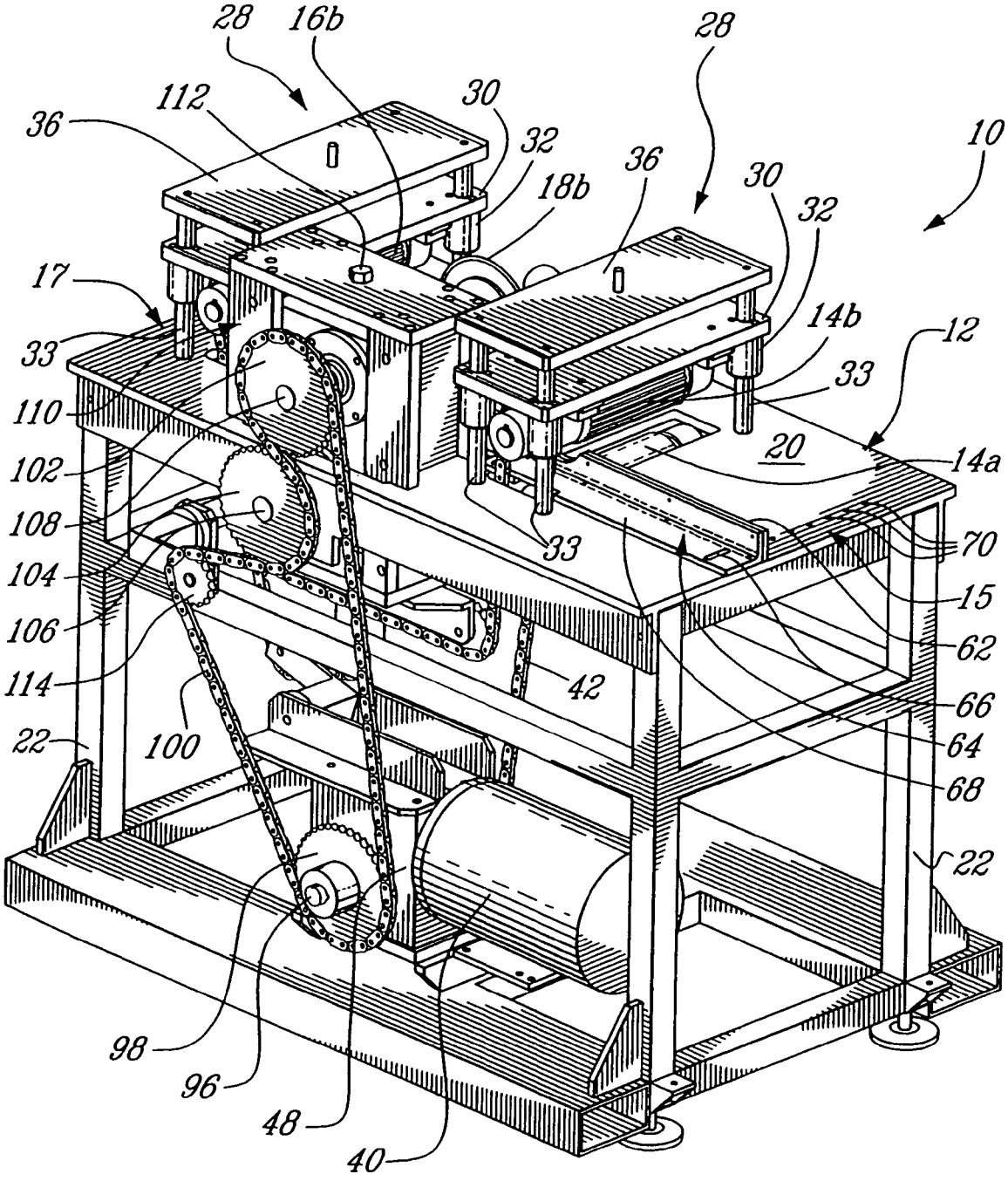
FIG. 2 is a back left perspective view of the sawdust-free wood cutting apparatus of FIG. 1.

Now referring to the drawings, and in particular to FIGS. 1 and 2, a sawdust-free wood cutting apparatus embodying the elements of the present invention and generally designated by the numeral 10 will be described. As will be seen hereinafter, by cutting with at least one blade, as opposed to sawing, it is possible to use virtually 100% of the volume of wood to be processed. That is to say that very little waste or no waste at all occurs in the wood cutting apparatus 10. This represents significant savings over conventional sawing devices wherein about 12% of the processed wood is transformed in sawdust.

The sawdust-free wood cutting apparatus 10 is intended to cut wood pieces, such as a wooden board, wood planks and lumbers. More specifically, the sawdust-free wood cutting apparatus 10 generally comprises a table 12, a pair of vertically spaced-apart feed rollers 14*a* and 14*b* at an upstream end 15 of the table 12, a pair of discharge rollers 16*a* and 16*b* at a downstream end 17 of the table 12, and a pair of coplanar circular cutting blades 18*a* and 18*b* between the pairs of feed and discharge rollers 14*a*, 14*b*, 16*a* and 16*b*.

The table 12 includes a horizontal planar support surface 20 supported above a ground surface by four legs 22 depending from the corners of the support surface 20. First and second axially spaced-apart rectangular slots are defined in the support surface 20 for respectively receiving the feed roller 14*a* and the discharge roller 16*a* with the peripheral side surface of the rollers 14*a* and 16*a* substantially flush with the top surface of the support surface 20. According to the illustrated embodiment, the feed roller 14*a* and the discharge roller 16*a* are identical and journaled to the table 12 for free rotation about respective rotating axes. The rollers 14*a* and 16*a* are not power driven and are caused to be rotated only by the piece of wood W (FIGS. 7 and 8) traveling thereon from the upstream end 15 of the table 12 to the downstream end 17 thereof.

The feed roller 14*b* and the discharge roller 16*b* are adapted to frictionally engage a top surface of the piece of wood W (FIGS. 7 and 8) to be cut and are supported by respective overhead mounting structures 28. As shown in FIGS. 1, 2, 4, 5 and 7, each mounting structure 28 includes a roller mounting plate 30 provided with downwardly depending cylindrical bushings 32 at the corners thereof for sliding movement along four vertical cylindrical rods 33 extending upwardly from the support surface 20. Each roller mounting plate 30 carries a pair of laterally spaced-apart pillow blocks 34 (FIG. 8) on an undersurface thereof for rotatably supporting one of the feed roller 14*b* and discharge roller 16*b*. A top plate 36 is secured to the upper distal end of the rods 33. An adjustable biasing structure 38, such as a spring or a piston and cylinder arrangement, is provided between the top plate 36 and the underlying roller mounting plate 30 to provide adjustability for vertical translating and positioning of the rollers 14*b* and 16*b* against the top surface of the piece of wood W to be processed.

The upper feed and discharge rollers 14*b* and 16*b* are preferably ribbed and made of a material having a high coefficient of friction to prevent any slippage between the piece of wood W and the rollers 14*b* and 16*b* while the piece of wood W is being advanced by the rollers 14*b* and 16*b* through the apparatus 10.

Figure 5:
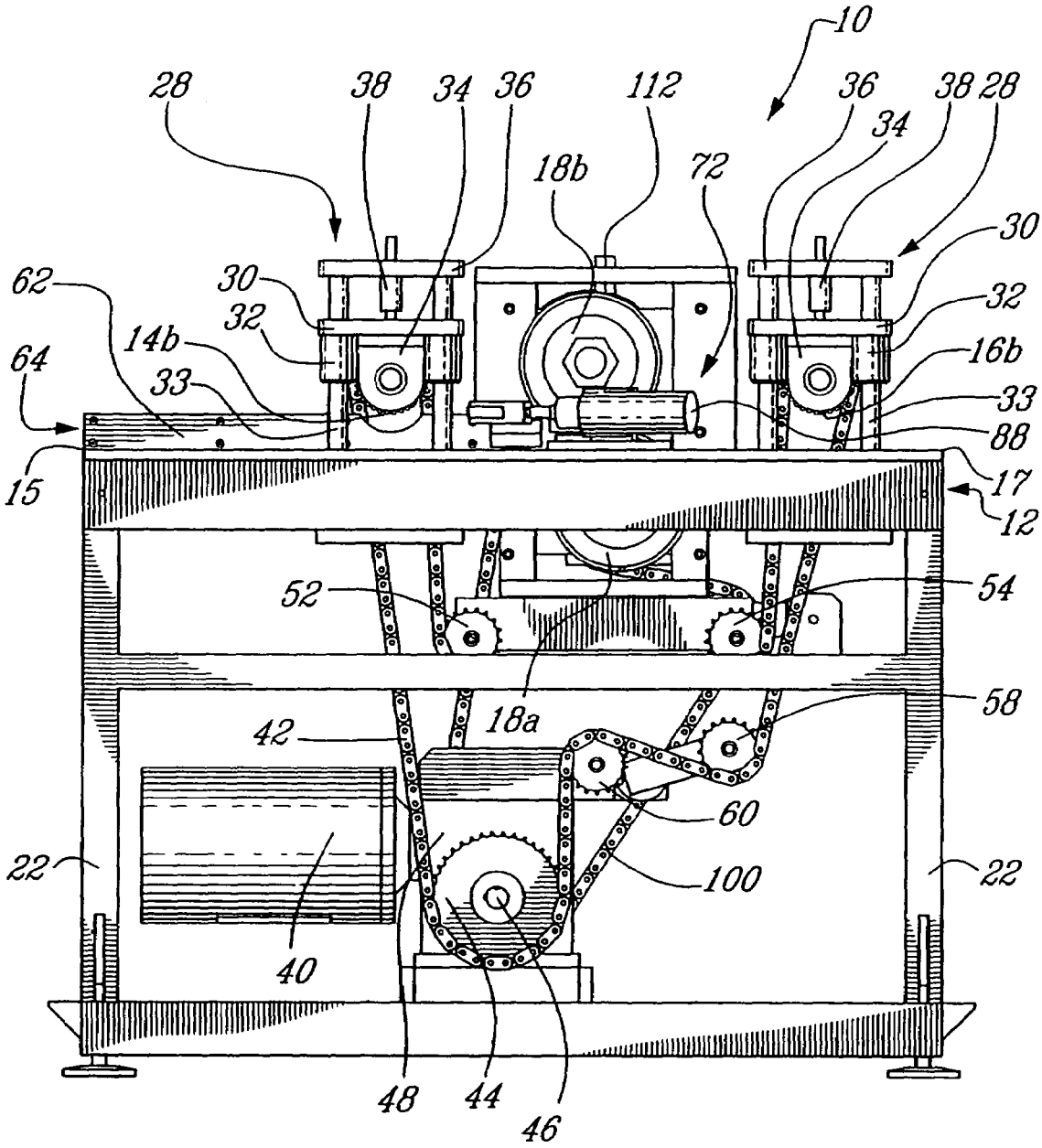
FIG. 5 is a front elevation view of the sawdust-free wood cutting apparatus.
Figure 6:
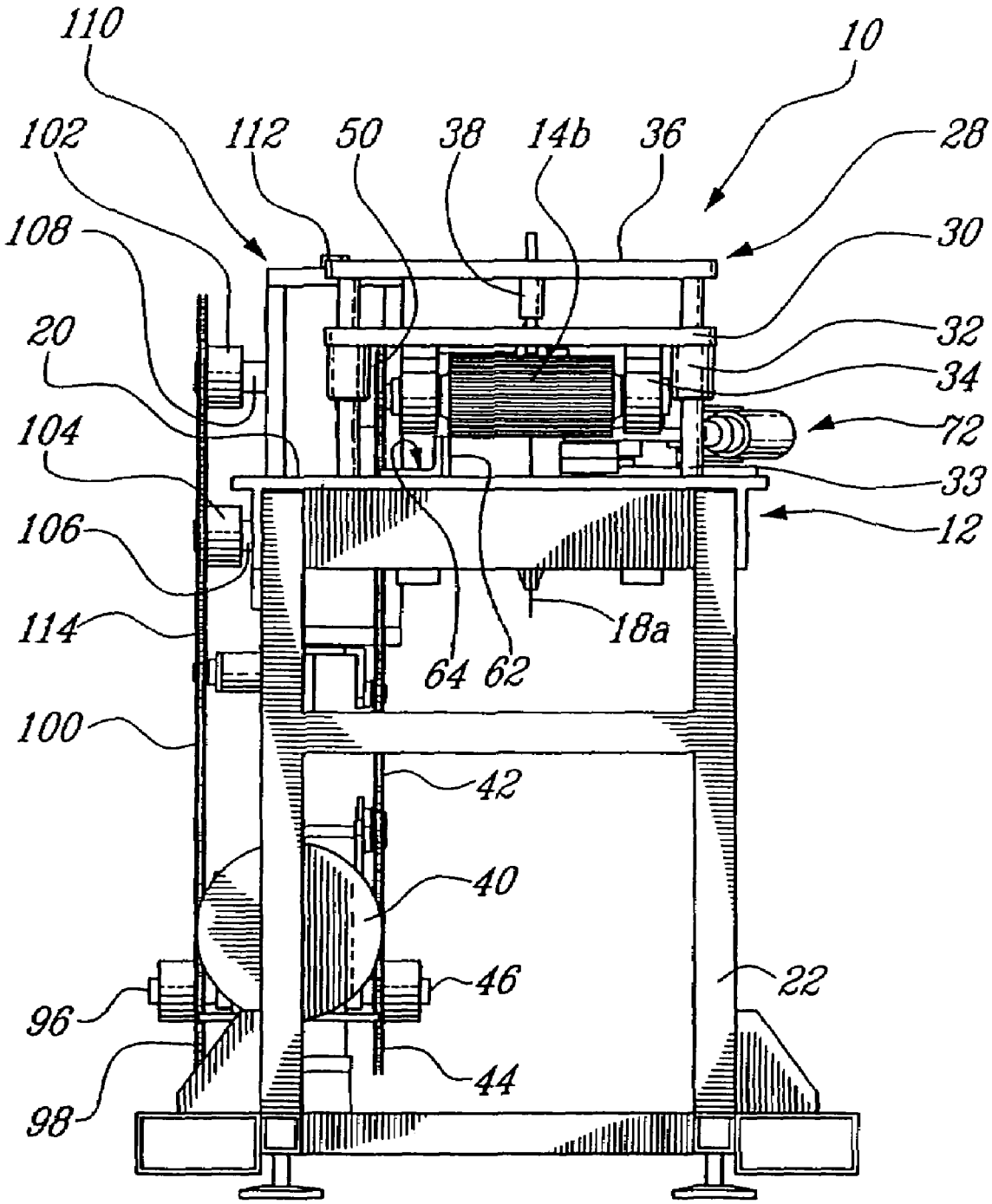
FIG. 6 is an end view of an inlet end of the sawdust-free wood cutting apparatus.

As shown in FIG. 5, the feed roller 14*b* and the discharge roller 16*b* are both power driven by a motor 40 via an endless drive chain 42 engaged on a sprocket wheel 44 mounted on a first output shaft 46 of a gear box 48 operatively connected to the motor 40. The drive chain 42 extends over a sprocket wheel 50 (FIG. 6) connected to the feed roller 14*b* and then over two intermediate sprockets 52 and 54 mounted to the table 12. The drive chain 42 extends from the. sprocket 54 to another sprocket 56 (FIG. 4) connected to the discharge roller 16*b*. The chain 42 then engages a second pair of intermediate sprockets 58 and 60, which are mounted to the table 12, before returning to the sprocket 44. The sprockets 50 and 56 are identical to ensure that the tangential speed at the periphery of the rollers 14*b* and 16*b* is equal. This speed corresponds to the advancing speed of the wood piece W through the apparatus 10.

Figure 3:
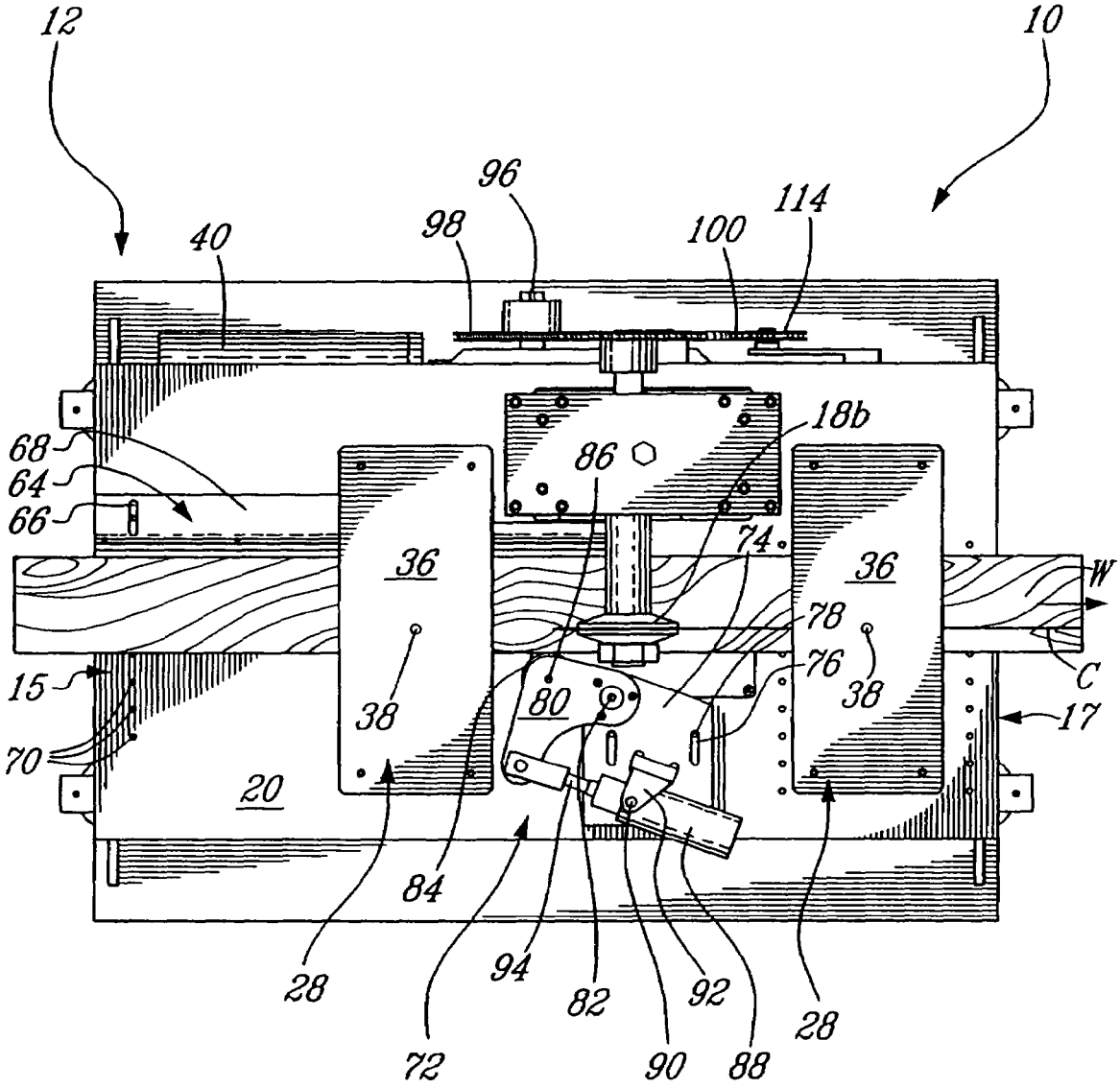
FIG. 3 is a top plan view of the sawdust-free wood cutting apparatus.
Figure 4:
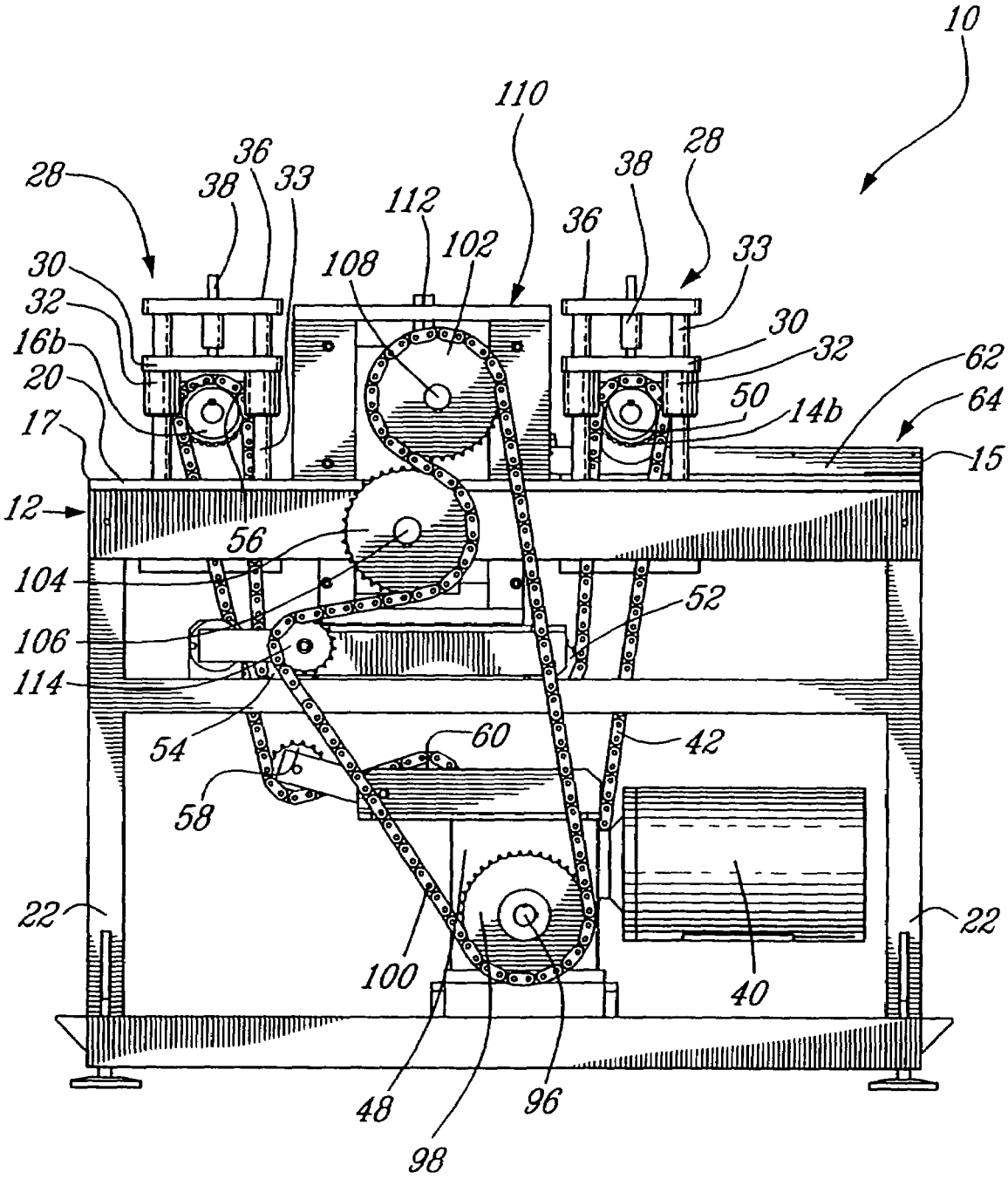
FIG. 4 is a back elevation view of the sawdust-free wood cutting apparatus.

The piece of wood W is guided along a rectilinear feed path through the apparatus 10 in order to ensure straight cuts C (FIG. 3). As best shown in FIG. 3, this is achieved by urging one lateral edge of the piece of wood W in sliding contact with a vertical guiding surface 62 of an axially extending angle iron 64 or the like adjustably mounted on one side of the feed path. The angle iron 64 has a horizontal foot 68 in which a given number of slots 66 are defined for receiving fasteners. A plurality of fastener receiving holes 70 are defined in the support surface 20 of the table 12 for allowing the angle iron 64 to be secured in a variety of lateral positions on the support surface 20.

The piece of wood W, while traveling on the table 12, is urged against the vertical guiding surface 62 by a pushing mechanism 72 mounted on the support surface 20 on a side of the feed path opposite to the angle iron 64. As shown in FIGS. 1 and 3, the pushing mechanism 72 includes a base plate 74 defining a pair of slots 76 (FIG. 3) adapted to receive fasteners 78 (FIG. 3) for adjustably mounting the base plate 74 on the support surface 20 of the table 12. A pivot plate 80 having a boomerang-like shape is pivotally mounted at 82 to the base plate 74 for pivotal movement about a vertical axis. The pivot plate 80 carries at an apex thereof a roller 84 having a vertical pivot axis 86. A pneumatic cylinder 88 or the like is pivotally mounted at 90 to a bracket 92 fixed to the base plate 74. The pneumatic cylinder 88 has a piston 94 having a distal end pivotally connected to one end of the pivot plate 80 opposite the pivot 82. The pneumatic cylinder 88 is adjusted to bias the roller 84 in rolling contact with one side of the piece of wood W and, thus, maintain the other side of the piece of wood W in sliding contact the guiding surface 62.

Figure 7:
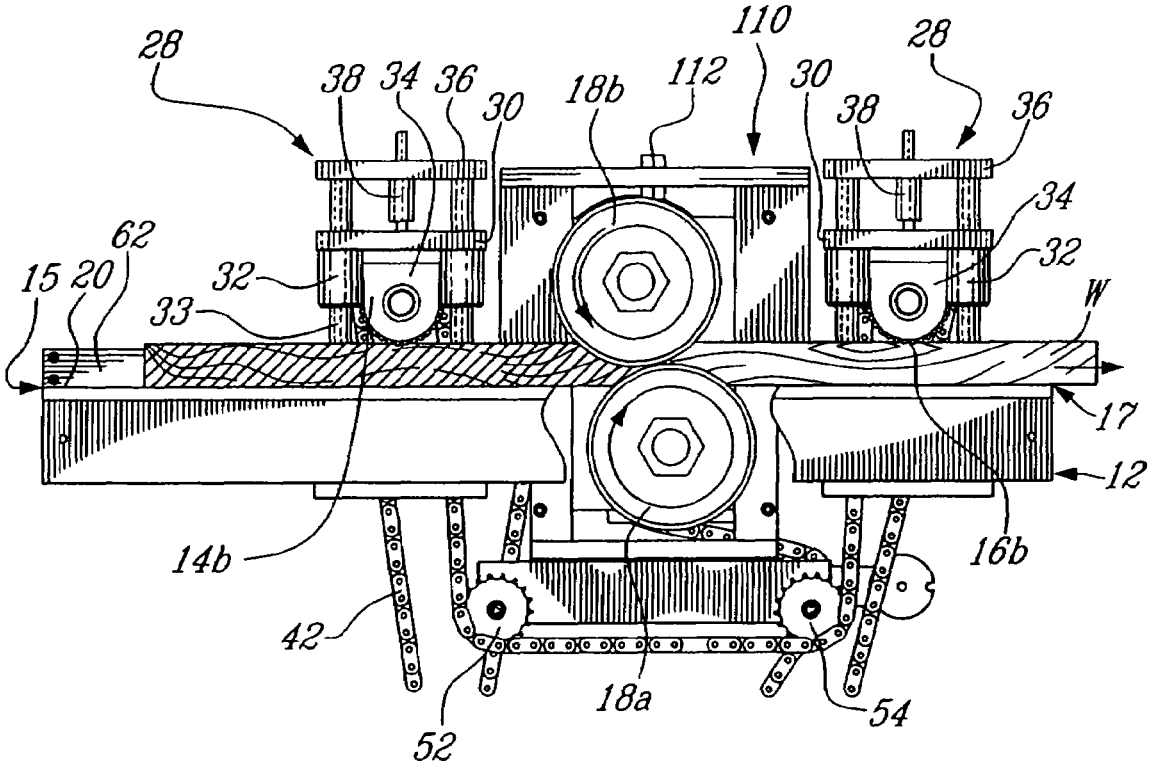
FIG. 7 is an enlarged front view of a discharge end of the sawdust-free wood cutting apparatus.
Figure 8:
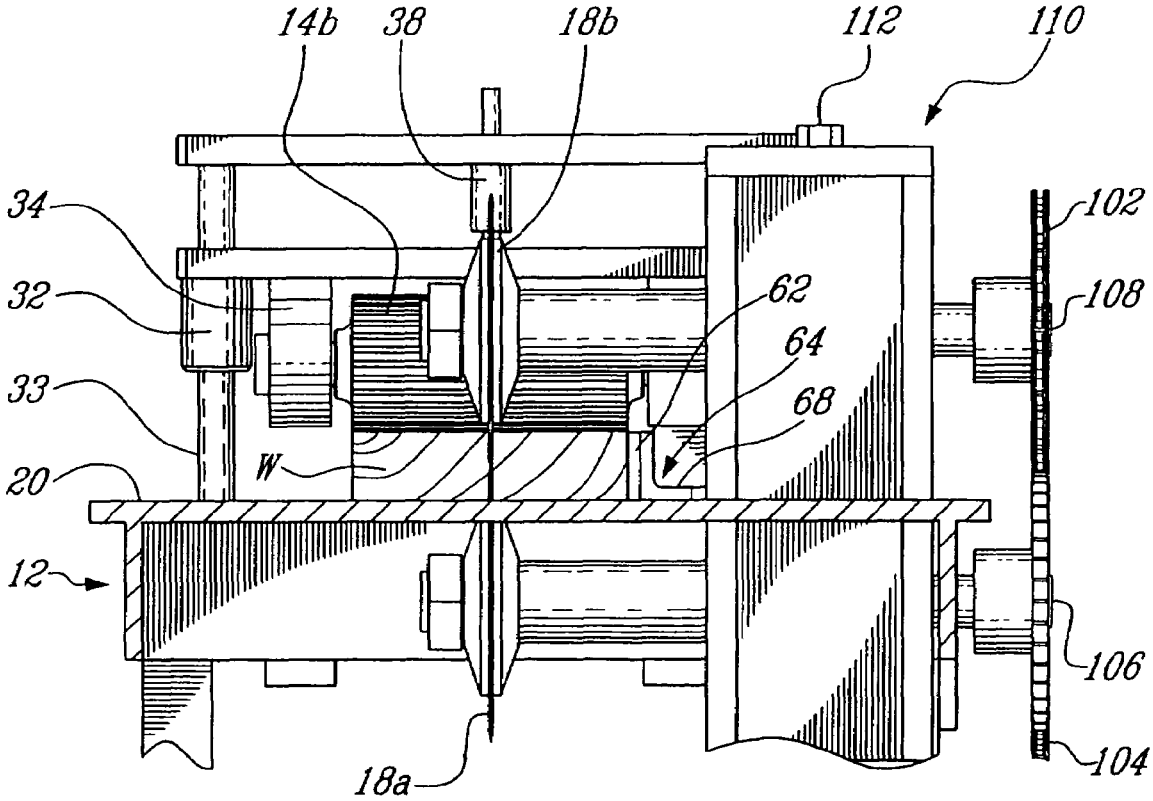
FIG. 8 is an enlarged end view, partly broken away, of the sawdust-free wood cutting apparatus.

The piece of wood W is cut longitudinally into two parts by the combined action of the axially spaced coplanar circular cutting blades 18*a* and 18*b*. As best shown in FIG. 7, the lower and upper coplanar blades 18*a* and 18*b* are placed slantwise behind each other so that their combined penetration depth equals at least the thickness of the piece of wood W to ensure a complete cut therethrough. The blades 18*a* and 18*b* are provided in the form of smooth edged circular blades. According to the illustrated embodiment, both blades have the same diameter and a same sharpened circumferential edge. As shown in FIG. 8, each blade 18*a*/18*b* tapers on each blade side around its sharpened circumferential edge regions. Satisfactory results have been obtained with 8 inches diameter blades having a 0.110 inch thick peripheral edge region. Spruce pieces of 2 inches thick have been cut in the wood fiber direction using such blades. Spruce pieces having a thickness of ⅝ inch have also been cut in a direction transversal to the wood fiber.

As shown in FIG. 8, the circular blades 18*a* and 18*b* are fixedly mounted to respective shafts 106 and 108 journaled to a box-like structure 110 mounted on the table 12.

The upper circular blade 18*b* is vertically adjustable by a screw adjustment mechanism generally depicted at 112.

The blades 18*a* and 18*b* are driven at the same speed but in opposite directions by the motor 40. As shown in FIG. 2, the gear box 48 is provided with a second output shaft 96 having a sprocket wheel 98 mounted thereon. An endless drive chain 100 extends over the sprocket wheel 98 for transmitting power to two other sprocket wheels 102 and 104 respectively mounted to the shafts 108 and 106 of the upper and lower circular cutting blades 18*b* and 18*a*. A tensor equipped with a sprocket wheel 114 is engaged with the drive chain 100 to maintain an appropriate tension therein.

In operation, the blades 18*a* and 18*b* are driven at the same speed but in opposite directions (see FIG. 7) so that the tangential speed at the outer circumference thereof be equal to the advancing speed of the piece of wood W advanced from the upstream end 15 of the table 12 to the downstream end thereof 17 by the feed and discharge rollers 14*b* and 16*b*. By so passing the wood piece W between a pair of lower and upper toothless blades 18*a* and 18*b* driven at a speed corresponding to advancing speed of the piece of wood W, the piece of wood W is cut, as opposed to being sawn, and virtually no sawdust is generated. By having no differential of speed between the tangential speed at the circumference of the blades 18*a* and 18*b* and the piece of wood W, the friction between the blades 18*a* and 18*b* and the piece of wood W is almost reduced to zero.

The above-described driving arrangement of sprocket wheels and chains driving the feed roller 14*b*, the discharge roller 16*b* and the blades 18*a* and 18*b* guarantee the equality of the advancing speed of the wood piece W and the tangential speed of the blades 18*a* and 18*b*. The advancing speed of the piece of wood W through the apparatus 10 may be about 365 feet/minutes.

Although the preferred embodiment of the present invention has been described as including a pair of coplanar circular blades, it is also contemplated to use a single cutting blade.

The invention claimed is:

1. A sawdust-free cutting apparatus comprising:

a frame, a guide mounted to said frame for guiding a workpiece along a feed path having a cutting zone, at least one circular blade mounted in said cutting zone and driven in rotation about an axis transversal to said feed path, said circular blade having a toothless circumferential cutting edge, a source of power driving said circular blade about said axis, and a feeder advancing the workpiece to be cut through said cutting zone at a linear speed substantially equal to a tangential speed at said toothless circumferential cutting edge of said circular blade, wherein said at least one circular blade tapers on each blade side around the toothless circumferential cutting edge, thereby providing a V-shaped cutting edge with two opposed slanted sides;

and wherein said guide includes a lateral guiding surface provided along one side of said feed path and having a straight face opposing one said slanted side of the cutting edge of the at least one blade, said guide including a roller mounted on one side of said feed path and biased in rolling engagement with a side of the workpiece while the workpiece is advanced along said feed path, said roller being rotatably mounted on a pivot plate, said pivot plate being pivotally mounted for pivotal movement about an axis normal to a support surface of said frame, said roller being maintained in contact with the workpiece by a piston and cylinder arrangement, said piston and cylinder arrangement including a piston pivotally connected to said pivot plate, the piston being linearly slidable in a cylinder pivotally connected to a base plate to which said pivot plate is mounted.

2. A sawdust-free cutting apparatus as defined in claim 1, wherein said base plate is adjustably mounted to said support surface of said frame for releasably securing the base plate at various distances from an axially extending gliding surface provided on a side of said feed path opposite said roller.

3. A sawdust-free cutting apparatus as defined in claim 1, wherein said source of power includes a single motor, and wherein said circular blade and said feeder are driven by said single motor through a gear box having first and second outputs respectively connected to first and second transmissions configured to ensure a linear speed ratio of 1:1 between the tangential speed at the circumferential cutting edge of the blade and the advancing speed imparted to the workpiece by the feeder.

4. A sawdust-free cutting apparatus as defined in claim 1, wherein said lateral guiding surface is provided on a side of said feed path opposite said roller, the roller pushing the workpiece against said guiding surface.

5. A sawdust-free cutting apparatus as defined in claim 4, wherein said lateral guiding surface is adjustably mounted to a support surface of said frame.

6. A sawdust-free cutting apparatus as defined in claim 1, wherein said feeder includes a power driven feed roller adapted to frictionally engage a top surface of the workpiece.

7. A sawdust-free cutting apparatus as defined in claim 6, wherein said feeder further includes a power driven discharge roller adapted to frictionally engage the top surface of the workpiece to be cut, said feed and discharge roller being respectively located upstream and downstream of said circular blade relative to a direction of travel of the workpiece through the apparatus.

8. A sawdust-free cutting apparatus as defined in claim 6, wherein said power driven feed roller is supported by an overhead mounting structure comprising a roller mounting plate mounted for vertical sliding movement along a vertical guide.

9. A sawdust-free cutting apparatus as defined in claim 8, wherein a biasing structure acts on the roller mounting plate for translating and positioning the feed roller against the top surface of the workpiece to be processed.

10. A sawdust-free cutting apparatus as defined in claim 9, wherein said biasing structure includes a piston and cylinder arrangement.

11. A sawdust-free cutting apparatus as defined in claim 1, wherein said at least one circular blade includes upper and lower circular blades, and wherein the blades are driven in opposite direction by said source of power so that the tangential speed at the periphery thereof be equal to the advancing speed of the workpiece to be cut.

12. A sawdust-free cutting apparatus as defined in claim 11, wherein said upper and lower circular blades are coplanar and placed slantwise behind each other.

* * * * *